US010938134B2

(12) United States Patent
Hara et al.

(10) Patent No.: US 10,938,134 B2
(45) Date of Patent: Mar. 2, 2021

(54) CONNECTOR AND ELECTRONIC DEVICE

(71) Applicant: JVCKENWOOD Corporation, Yokohama (JP)

(72) Inventors: Noriyuki Hara, Yokohama (JP); Toshiyuki Yakabe, Yokohama (JP); Noriaki Enomoto, Yokohama (JP)

(73) Assignee: JVCKENWOOD CORPORATION, Yokohama (JP)

( * ) Notice: Subject to any disclaimer, the term of this patent is extended or adjusted under 35 U.S.C. 154(b) by 0 days.

(21) Appl. No.: 16/780,069

(22) Filed: Feb. 3, 2020

(65) Prior Publication Data

US 2020/0251840 A1 Aug. 6, 2020

(30) Foreign Application Priority Data

Feb. 6, 2019 (JP) ..... JP2019-019752

(51) Int. Cl.

| | |
|---|---|
| ***H01R 13/64*** | (2006.01) |
| ***H01R 12/70*** | (2011.01) |
| ***H01R 13/74*** | (2006.01) |
| ***H01R 13/631*** | (2006.01) |
| ***H01R 12/72*** | (2011.01) |
| ***H01R 12/71*** | (2011.01) |

(52) U.S. Cl.

CPC ..... *H01R 12/7005* (2013.01); *H01R 12/716* (2013.01); *H01R 12/727* (2013.01); *H01R 13/631* (2013.01); *H01R 13/74* (2013.01)

(58) Field of Classification Search

CPC ..... H01R 12/7005; H01R 12/716; H01R 12/727; H01R 13/631; H01R 13/74

USPC ..... 439/247–252, 325

See application file for complete search history.

(56) References Cited

U.S. PATENT DOCUMENTS

| | | | | |
|---|---|---|---|---|
| 3,740,698 | A * | 6/1973 | Jerominek | H01R 12/78 439/61 |
| 6,435,897 | B1 * | 8/2002 | Paul | H01R 12/7005 439/374 |
| 7,128,595 | B2 * | 10/2006 | Boutros | H01R 13/6275 439/358 |
| 7,448,897 | B2 * | 11/2008 | Dawiedczyk | H01R 13/6275 439/357 |

FOREIGN PATENT DOCUMENTS

| | | |
|---|---|---|
| JP | 6427982 U | 2/1989 |

* cited by examiner

*Primary Examiner* — Khiem M Nguyen

(74) *Attorney, Agent, or Firm* — Nath, Goldberg & Meyer; Jerald L. Meyer

(57) ABSTRACT

A connector includes: a main body and a holder. The main body includes: a frame guiding a connected member in a mounting direction; a first support member being flexible toward the frame and protruding from the frame in a first outer direction; and a second support member being flexible toward the frame and protruding from the frame in a second outer direction. The holder include: first and second contact surfaces to which the first and second support members contact, respectively, when the main body has been inserted into the holder; and inclined surfaces inclined in a direction approaching the main body from both edges of each of the first and second contact surfaces. When the main body inside the holder moves in a direction orthogonal to the mounting direction, the first and second support member slide on the inclined surfaces and elastically deform in a direction approaching the frame.

4 Claims, 5 Drawing Sheets

CONNECTOR AND ELECTRONIC DEVICE

CROSS REFERENCE TO RELATED APPLICATIONS

This application is based on and claims priority from Japanese Patent Application No. 2019-019752, filed on Feb. 6, 2019, the entire contents of which are incorporated by reference herein.

BACKGROUND

The present disclosure relates to a connector and electronic device that absorbs misalignment in engagement between a plug and a receptacle.

Japanese Utility Model Publication No. S64-27982 describes a connector that absorbs misalignment in engagement between a plug and a receptacle.

SUMMARY

The connector described in Japanese Utility Model Publication No. S64-27982 includes a ring-shaped spring member that absorbs misalignment between the connector and a mounting member attached to the connector on each of the four sides of the rectangular connector housing. This structure makes the overall size reduction of the connector difficult.

Embodiments according to the present disclosure are directed to provide a connector and an electronic device that can be downsized while being able to absorb a misalignment when engaging a mounting member.

A connector according to an embodiment includes a main body and a holder being a frame body into which the main body is insertable. The main body of the connector includes: a connecting member that is one of a plug and a receptacle; a guide frame that guides in a mounting direction a connected member that is between the other of the plug and the receptacle and that is mounted to the connecting member; a first support member that protrudes in a first outer direction from the guide frame and that has flexibility in a direction approaching the guide frame; and a second support member that protrudes in a second outer direction, which is opposite of the first outer direction, from the guide frame and that has flexibility in a direction approaching the guide frame. The holder of the connector includes: a first contact surface that is an inner surface of the frame body and to which the first support member contacts when the main body has been inserted into the holder; a second contact surface that is the inner surface of the frame body and to which the second support member contacts when the main body has been inserted into the holder; and two pairs of inclined surfaces that incline in a direction approaching the main body from both edges of each of the first contact surface and the second contact surface. When the main body, which been inserted into the holder, moves in a direction orthogonal to a direction in which the main body is inserted into the holder and the first outer direction, the first support member and the second support member slide on the inclined surfaces and elastically deform in a direction approaching the guide frame.

An electronic device according to an embodiment includes a housing; and a connector as described above.

According to the embodiments, it is possible to be downsized while being able to absorb a misalignment when engaging a mounting member.

DETAILED DESCRIPTION

Figure 1:
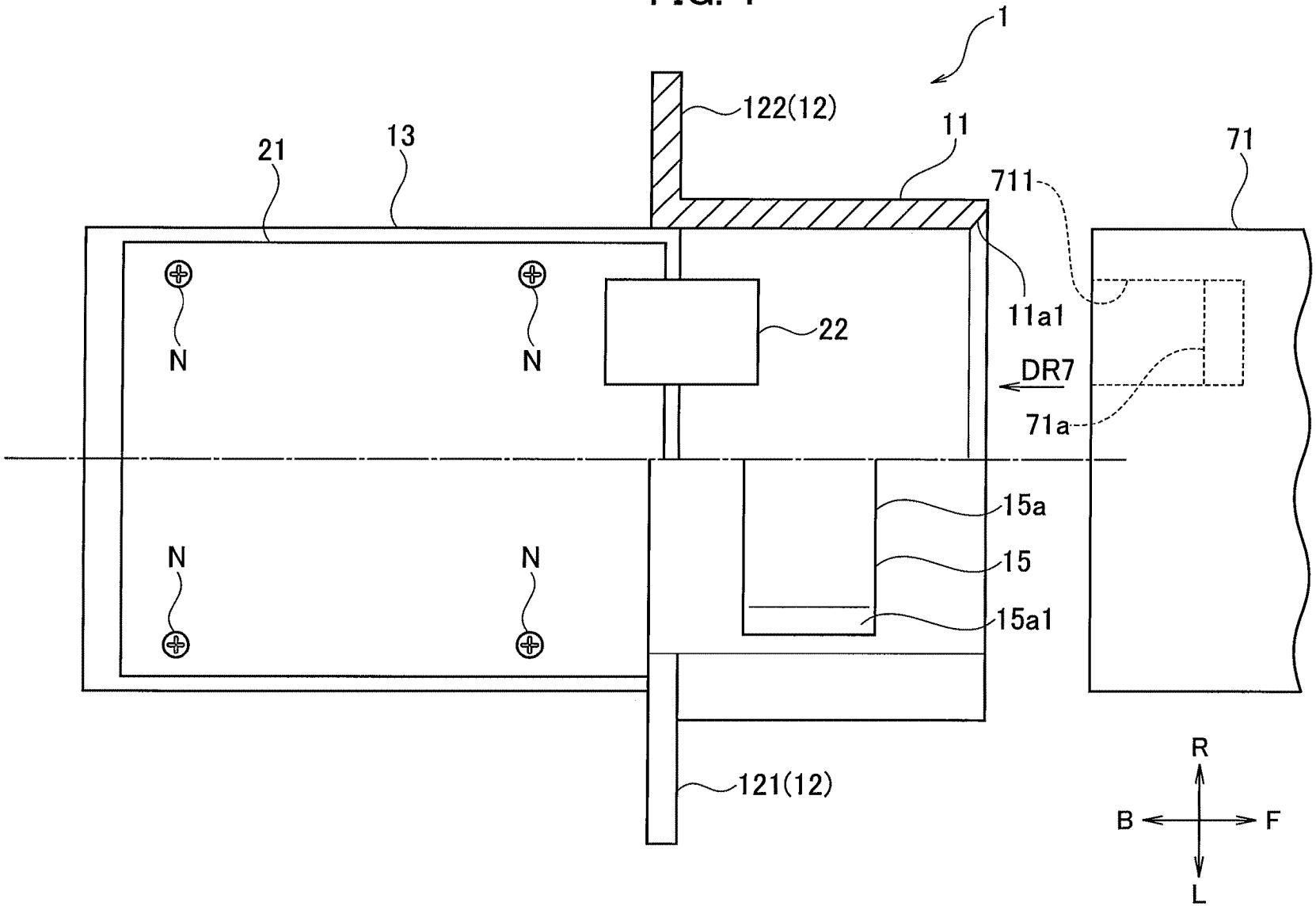
FIG. 1 is a plan view with a half section showing a main body of a connector according to an embodiment of the present disclosure.

A connector 51 according to an embodiment of the present disclosure will be described below. Note that F, B, L, R, U, and D in the drawings stand for front, back, left, right, up, and down, respectively, for convenience of explanation. However, these directions do not regulate the usage posture or the like of the connector 51.

Figure 5:
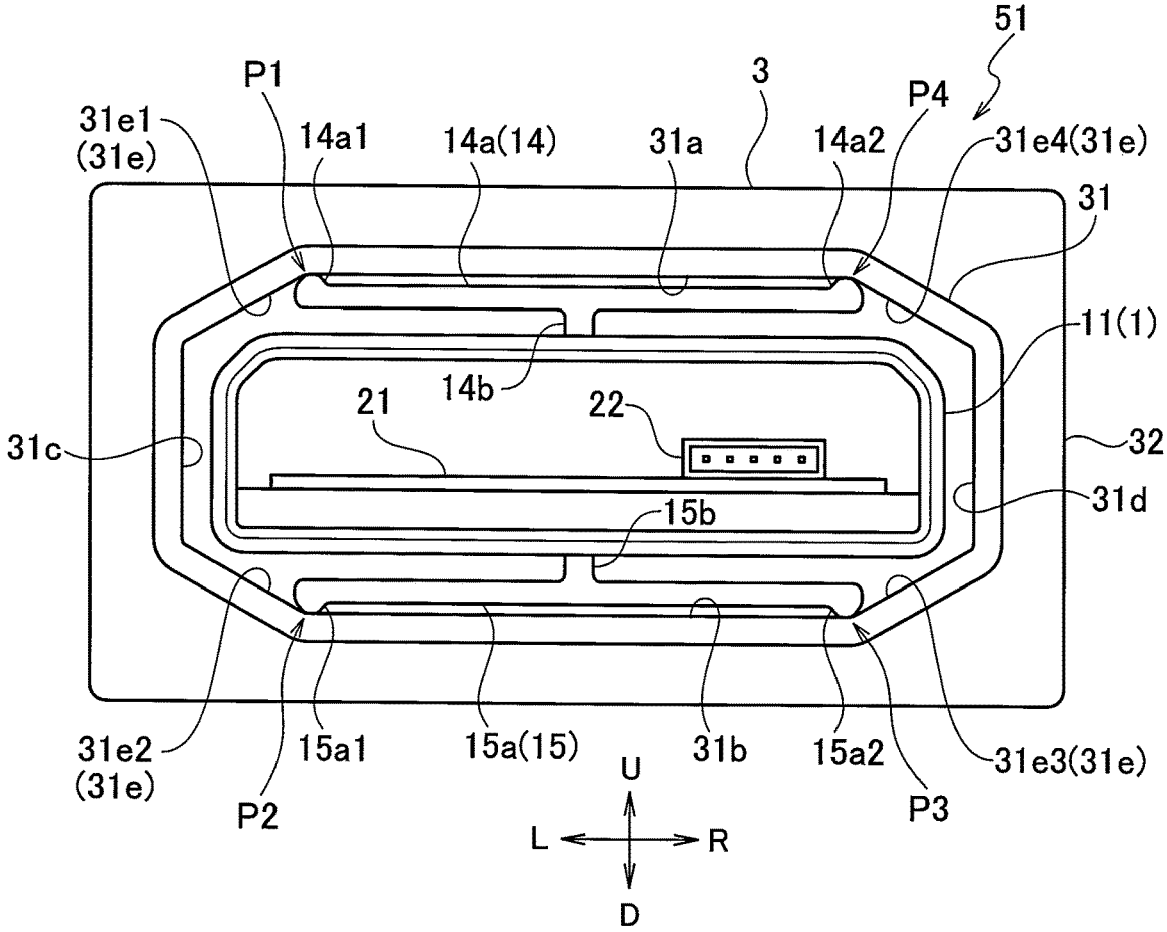
FIG. 5 is a front view of the connector.
Figure 6:
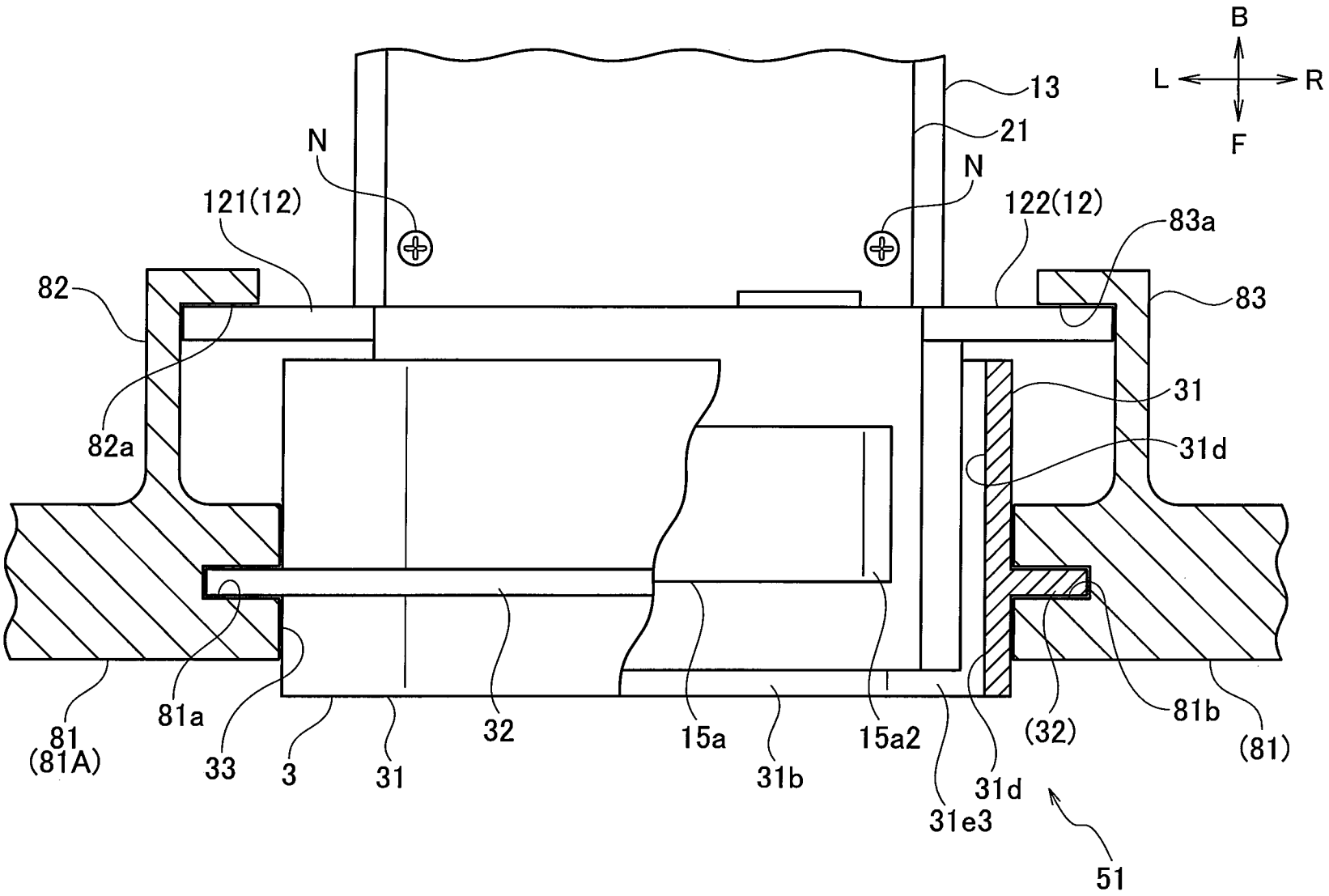
FIG. 6 is a partial plan view of a partial cross section showing a state in which the connector is attached to a housing.

The connector 51 includes a main body 1 shown in FIG. 1 and a holder 3 shown in FIGS. 5 and 6. The holder 3 is a frame body which is flat and rectangular annular. The connector 51 is used in a state that a part of the main body 1 is inserted inside the frame body of the holder 3.

Figure 2:
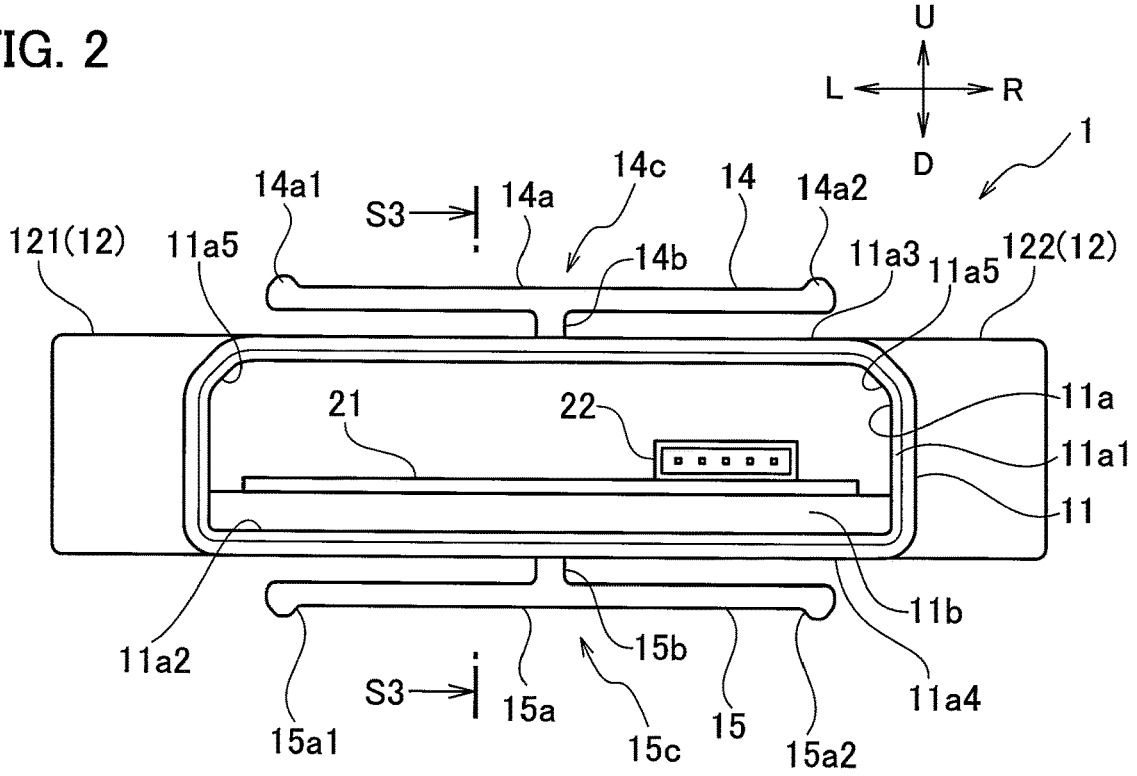
FIG. 2 is a front view of the main body.
Figure 3:
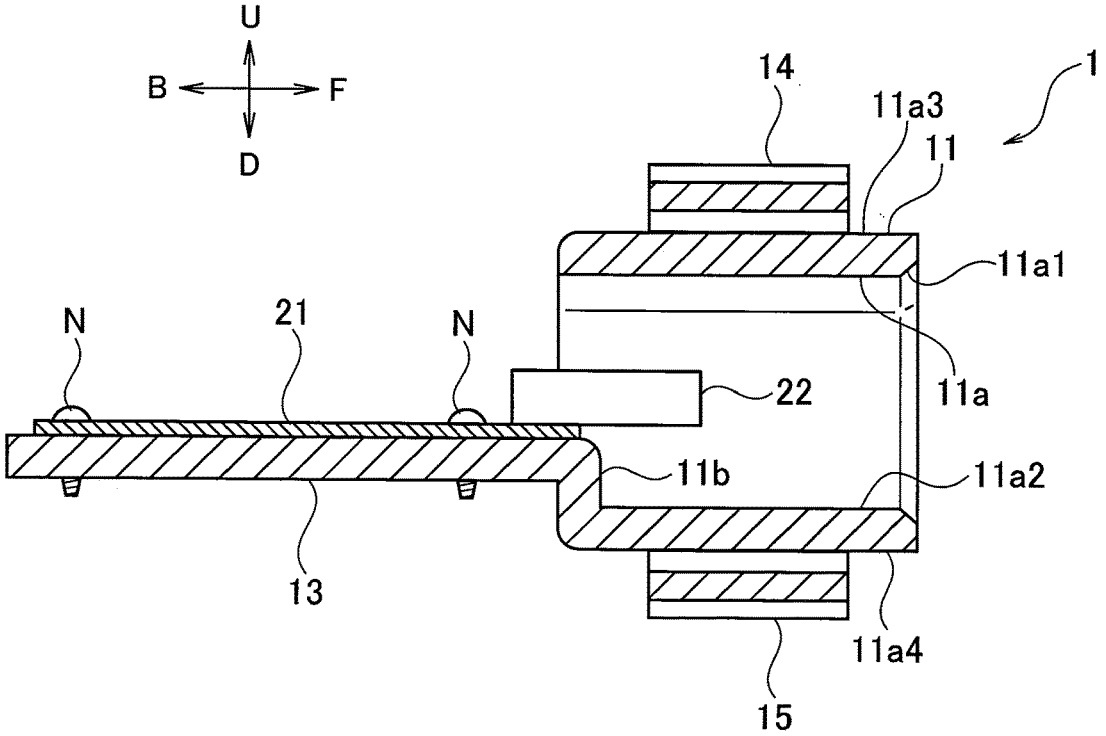
FIG. 3 is a cross-sectional view along positions S3-S3 shown in FIG. 2.

First, the main body 1 will be described in detail with reference to FIGS. 1 to 3. The main body 1 includes a guide frame 11 that is a thin, flat frame-like body, a flange portion 12 that extends in the left and right directions from the guide frame 11, and a substrate support 13 that extends in the back direction from the guide frame 11. A step portion 11*b* that rises in the up direction is formed at a rear end of a bottom surface 11*a*2 of an inner surface 11*a*of the guide frame 11. A front end portion of the substrate support 13 is connected to an upper end portion of the step portion 11*b*.

A substrate 21 is placed on an upper surface of the substrate support 13. The substrate 21 is fixed to the substrate support 13 at a plurality of locations by screws N. A plug 22 as a connection component is mounted on a front end portion of the substrate 21 so as to protrude in the front direction from the step portion 11*b*.

On an inner edge of a front end surface of the guide frame 11 is formed a guiding portion 11*a*1 by chamfering. The guiding portion 11*a*1 serves as a guide for guiding a memory unit 71 so that the memory unit 71 can be smoothly inserted into the guide frame 11 along a mounting direction. Inclined portions 11*a*5 are formed at the upper left and right ends of an inner surface of the guide frame 11.

A first support member 14 and a second support member 15 are formed on an upper surface 11*a*3 and a lower surface 11*a*4 on an outer surface of the guide frame 11, respectively. Because the first support member 14 and the second support member 15 have the same shape but upside down, the first support member 14 will be described as a representative.

The first support member 14 includes a flat base portion 14*a* and a column portion 14*b*. The column portion 14*b* is rib shaped and extends in a first outer direction that extends in the up direction extending in the front-back direction from a substantially central portion in the left-right direction and the front-back direction of the upper surface 11*a*3. The tip of the column portion 14*b* is connected to a connection portion 14*c* that is a central part of the base portion 14*a* in the left-right direction. A first contact portion 14*a*1 that protrudes in the up direction is formed at the left end portion of the base portion 14*a*, and a second contact portion 14*a*2 that protrudes in the up direction is formed at the right end portion. Both the ends of the base portion 14*a* warp in the vertical direction with the connecting portion 14*c* as a fulcrum. Accordingly, the first contact portion 14*a*1 and the second contact portion 14*a*2 can warp in the vertical direction with respect to the connection portion 14*c*.

The second support member 15 has the same structure as the first support member 14. That is, both ends of a base portion 15*a* warp in the vertical direction with a connection portion 15*c* as a fulcrum. A third contact portion 15*a*1 and a fourth contact portion 15*a*2 corresponding to the first contact portion 14*a*1 and the second contact portion 14*a*2 are formed at both ends of the base portion 15*a*. The base portion 15*a* is connected at the connecting portion 15*c* to a column portion 15*b* that protrudes in a second outer direction that extends in the down direction from the lower surface 11*a*4. Accordingly, the third contact portion 15*a*1 and the fourth contact portion 15*a*2 of the second support member warp in the vertical direction with respect to the connection portion 15*c* to which the column portion 15*b* is connected.

Figure 4:
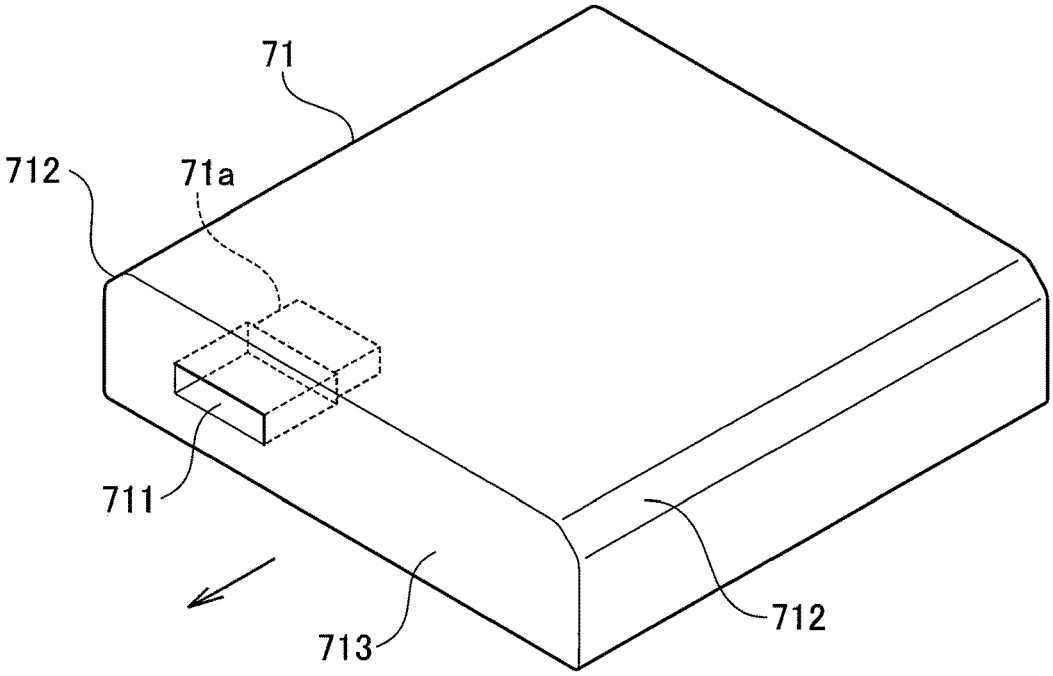
FIG. 4 is a perspective view showing a memory unit that can be mounted to the connector.

FIG. 4 is a perspective view showing the memory unit 71 that can be mounted to the connector 51. The memory unit 71 is a flat hexahedron, and has a pair of ridge lines having inclined portions 712. When the memory unit 71 is mounted to the connector 51, the inclined portions 712 fit perfectly into the inside of the guide frame 11 with almost no gap between the two. The memory unit 71 has an insertion surface 713 that is the surface from which the connector 51 is inserted. A hole 711 is formed in the insertion surface 713 at a position corresponding to the plug 22 of the connector 51. A receptacle 71*a* as a connection component for connecting to the plug 22 is arranged behind the hole 711.

With this configuration, when the memory unit 71 is inserted into the guide frame 11, by moving along an arrow DR7 shown in FIG. 1, the plug 22 enters the hole 711 and engages with the receptacle 71*a*. Thus, the memory unit 71 and the substrate 21 get electrically connected. The memory unit 71 is inserted into the guide frame 11 up to a position where the insertion surface 713 contacts the step portion 11*b*.

As shown in FIGS. 5 and 6, the holder 3 includes an annular frame portion 31 that can be inserted through the guide frame 11 of the main body 1 and a flange portion 32 that protrudes outward from the frame portion in the vertical and horizontal directions. The frame portion 31 includes, as inner surfaces, a pair of contact surfaces 31*a* and 31*b* that extend in the front-back direction and oppose and are parallel to each other in the vertical direction, and a pair of non-contact surfaces 31*c* and 31*d* that extend in the front-back direction and oppose and are parallel to each other in the left-right direction. The contact surfaces 31*a* and 31*b* are also referred to as a first contact surface and a second contact surface, respectively.

Upper left and right corner portions where the contact surface 31*a* and the non-contact surfaces 31*c* and 31*d* are connected to each other are inclined surfaces 31*e*1 and 31*e*4, respectively. The inclined surfaces 31*e*1 and 31*e*4 are inclined toward the guide frame 11 from both ends of the contact surface 31*a*. Lower left and right corner portions where the contact surface 31*b* and the non-contact surfaces 31*c* and 31*d* are connected to each other are inclined surfaces 31*e*2 and 31*e*3, respectively. The inclined surfaces 31*e*2 and 31*e*3 are inclined from both ends of the contact surface 31*b* to the side approaching the guide frame 11. The inner shape of the frame portion 31 is formed larger than the outer shape of the guide frame 11 of the main body 1 by a predetermined distance in each of the vertical and horizontal directions and the oblique directions.

The connector 51 is used in a usage mode in which the main body 1 is inserted in the frame portion 31 and is connected. In the usage mode, the first support member 14 of the main body 1 is in contact with the contact surface 31*a* of the frame portion 31, and the second support member 15 is in contact with the contact surface 31*b*. More specifically, as shown in FIG. 5, the first contact portion 14*a*1 of the first support member 14 contacts a connection point P1, or near the connection point P1, where the inclined surface 31*e*1 contacts the contact surface 31*a*, and the second contact portion 14*a*2 contacts a connection point P4, or near the connection point P4, where the inclined surface 31*e*4 contacts the contact surface 31*a*. Further, the third contact portion 15*a*1 of the second support member 15 contacts a connection point P2, or near the connection point P2, where the inclined surface 31*e*2 contacts the contact surface 31*b*, and the fourth contact portion 15*a*2 contacts a connection point P3, or near the connection point P3, where the inclined surface 31*e*3 contacts the contact surface 31*b*.

It is allowable that the main body 1 enters into the holder 3 so that the first support member 14 and the second support member 15 are slightly deformed inward and bias each of the contact surfaces 31*a* and 31*b* of the frame portion 31.

As shown in FIG. 6, the connector 51 performs positioning of the holder 3 with respect to a housing (casing) 81 of an electronic device 81A that is a member to be attached by inserting and engaging the flange portion 32 of the holder 3 into grooves 81*a* and 81*b* formed in advance. Further, flange portions 121 and 122 in the main body 1 are locked to locking portions 82*a* and 83*a* provided on an inner side of locking arm portions 82 and 83 formed in the housing 81, respectively, and a movement in the back direction of the main body 1 with respect to the holder 3 is regulated. A movement in the front direction of the main body 1 relative to the holder 3 is regulated by the flange portion 12 coming into contact with a back surface of the frame portion 31 of the holder 3. That is, in the usage mode of the connector 51, the main body 1 is substantially prohibited from moving in the front-back direction with respect to the holder 3. Inside the housing is electrically connected to the substrate 21.

With the configuration described above, when the memory unit 71 is inserted in the guide frame 11, even if there is a misalignment between the guide frame 11 and the memory unit 71 in the direction orthogonal to the entering direction, at least one of the first support member 14 and the second support member 15 bends toward the guide frame 11 side. Thereby, the guide frame 11 can move in a direction orthogonal to the direction of insertion. That is, movement of the guide frame 11 due to the misalignment is permitted. In other words, misalignment is absorbed.

In a natural state (a free state) where the memory unit 71 is not attached to the guide frame 11, the axis of the guide frame 11 substantially matches the axis of the frame portion 31. In other words, the gap between the guide frame 11 and the frame portion 31 is substantially the same with no deviation in the up-down and left-right directions. Therefore, the dimensions, shape, and elasticity of the first support member 14 and the second support member 15, and a balance between a counterforce that the first support member 14 and the second support member 15 receive from the frame portion 31 and an elastic repulsive force of the first support member 14 and the second support member 15 is taken into consideration.

Figure 7:
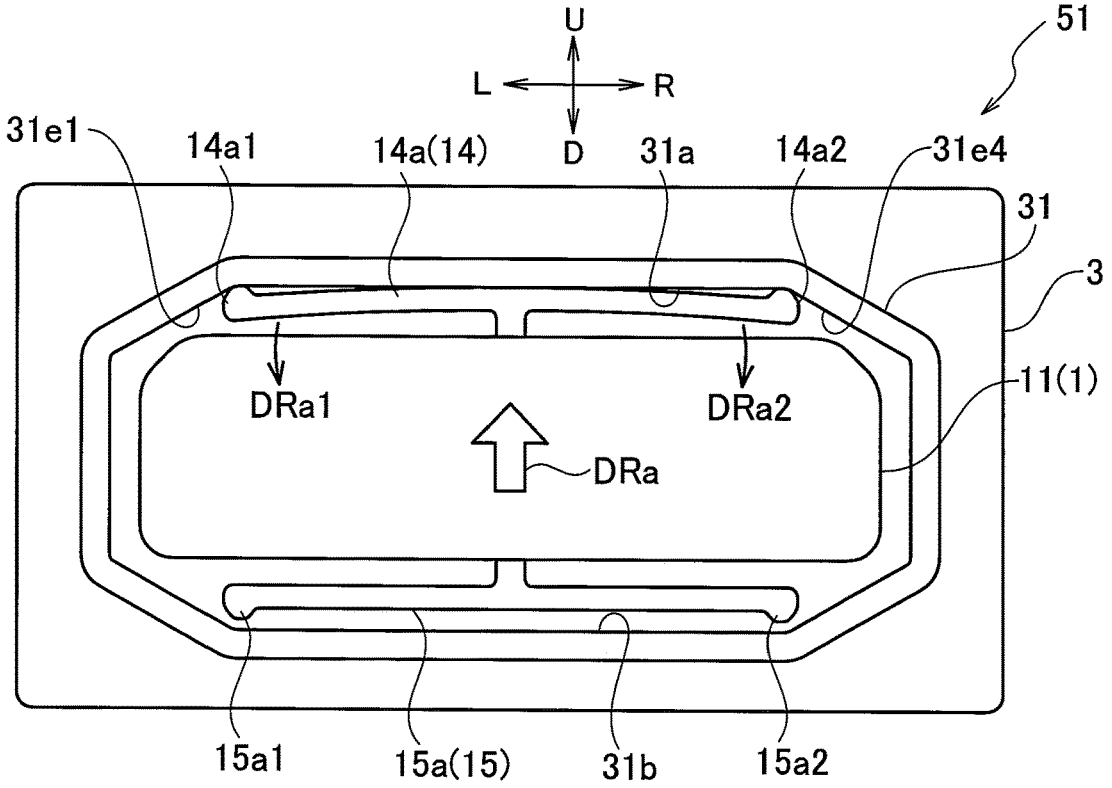
FIG. 7 is a front view showing a first operation of the connector.

With respect to this natural state, as shown in FIG. 7, when the memory unit 71 is inserted in the guide frame 11, if the position of the memory unit 71 is shifted up as shown by an arrow DRa, the guide frame 11 is biased in the up direction. By this biasing force, the first contact portion 14*a*1 and the second contact portion 14*a*2 of the first support member 14 bias the contact surface 31*a* and elastically deform in the down direction by the reaction force as indicated by arrows DRa1 and DRa2.

Thereby, the movement of the guide frame 11 in the up direction is allowed, and the movement is regulated at a position that balances the repulsive force of the first support member 14. For this reason, almost no force in the up-down direction is applied to the plug 22 of the substrate 21 engaged with the receptacle 71*a* of the memory unit 71, and the plug 22 and the substrate 21 do not malfunction.

Figure 8:
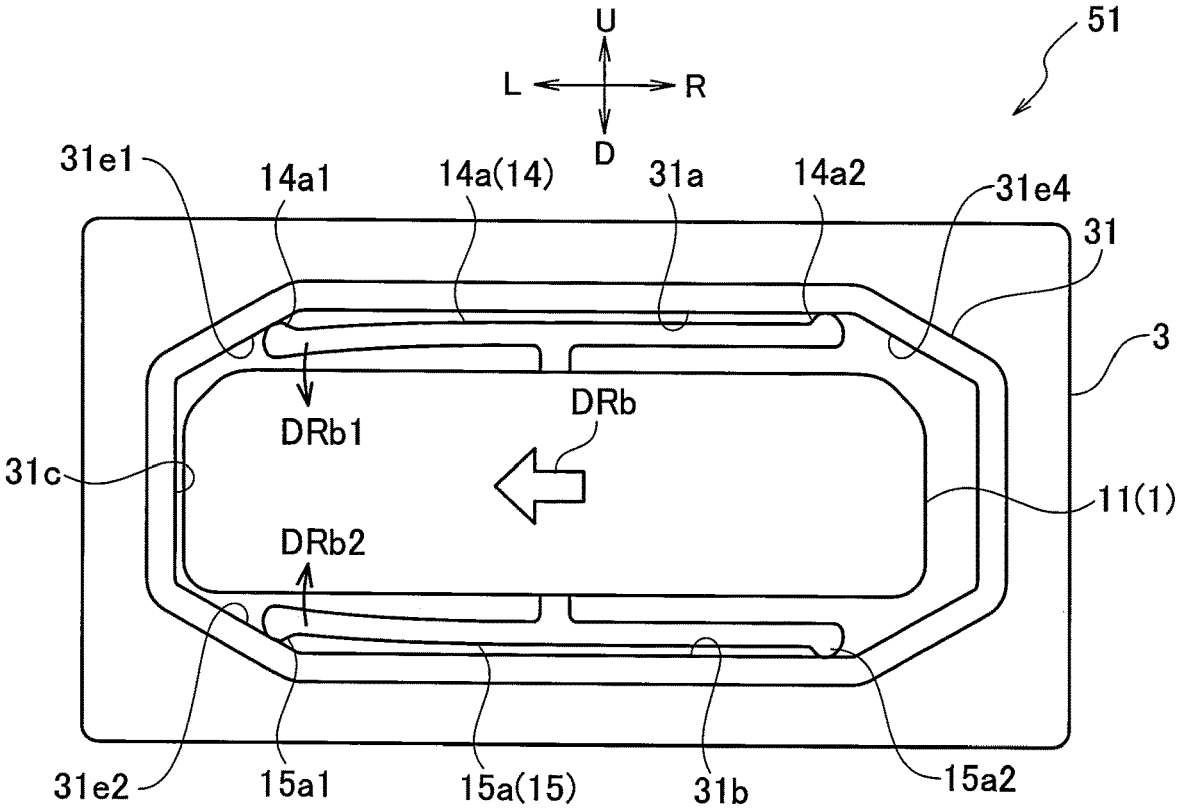
FIG. 8 is a front view showing a second operation of the connector.

On the other hand, as shown in FIG. 8, when the position of the memory unit 71 is shifted in the left direction as indicated by an arrow DRb, the guide frame 11 is biased to the left direction. By this biasing force, the first contact portion 14*a*1 of the first support member 14 and the third contact portion 15*a*1 of the second support member 15 slide on the inclined surface 31*e*1 and the inclined surface 31*e*2, respectively, and the first contact portion 14*a*1 is elastically deformed in the down direction as indicated by an arrow DRb1, and the third contact portion 15*a*1 is elastically deformed in the up direction as indicated by an arrow DRb2.

As a result, the movement of the guide frame 11 in the left direction due to the misalignment is permitted, and this movement thereof is regulated to a position at which the biasing force to the left direction of the guide frame 11 and a total force of the right direction components of the repulsive forces generated in each of the first contact portion 14*a*1 and the third contact portion 15*a*1 are balanced. Therefore, almost no force in the up-down direction is applied to the plug 22 on which the receptacle 71*a* of the memory unit 71 is mounted, and the plug 22 and the substrate 21 do not malfunction.

If the position of the memory unit 71 to be inserted into the guide frame 11 is not shifted to top/bottom/left/right direction, but shifted diagonally, the deformation shown in FIG. 7 and the deformation shown in FIG. 8 occur in the same way, allowing the guide frame 11 to move in an oblique direction, and the movement is restricted at a position at which the repulsive forces due to the deformation of the first support member 14 and the second support member are balanced.

Thus, at a position between the frame portion 31 and the guide frame 11, the connector 51 is held between the first support member 14 and the second support member 15 formed in the up-down direction, but there is nothing in the left-right direction. Therefore, the connector 51 can downsized in the left-right direction. That is, the connector 51 can be downsized while being able to absorb a misalignment at the time of fitting with the memory unit 71 that is the mounting member.

The material of the main body 1 and the holder 3 constituting the connector 51 are not limited. For example, the main body 1 can be made of resin, and the holder 3 can be made of resin or metal.

The embodiment described in detail above is not limited to the above-described configuration, and may be modified without departing from the gist of the present disclosure.

The mounting member attachable to the connector 51 is not limited to the memory unit. The receptacle may be arranged on the connector 51 side, and the plug may be arranged on the mounting member side. The base portions 14*a* and 15*a* of the first support member 14 and the second support member 15 are not limited to those having a plate shape as described above. Any shape and material that can be elastically deformed by contact with the contact surfaces 31*a* and 31*b*, such as a ring shape or a zigzag shape, may be used. The guide frame 11 and the frame portion 31 do not have to be formed in a closed ring shape, and may have a slit that makes the ring discontinuous. For example, it may be formed in a shape of English letter C.

According to the embodiment, it is possible to achieve downsizing while absorbing the misalignment when engaging the mounting member.

What is claimed is:

1. A connector comprising:

a main body including:

a connecting member that is one of a plug and a receptacle;

a guide frame that guides in a mounting direction a connected member that is between the other of the plug and the receptacle and that is mounted to the connecting member;

a first support member that protrudes in a first outer direction from the guide frame and that has flexibility in a direction approaching the guide frame; and a second support member that protrudes in a second outer direction, which is opposite of the first outer direction, from the guide frame and that has flexibility in a direction approaching the guide frame; and a holder being a frame body into which the main body is insertable, including:

a first contact surface that is an inner surface of the frame body and to which the first support member contacts when the main body has been inserted into the holder;

a second contact surface that is the inner surface of the frame body and to which the second support member contacts when the main body has been inserted into the holder; and two pairs of inclined surfaces that incline in a direction approaching the main body from both edges of each of the first contact surface and the second contact surface, wherein, when the main body, which been inserted into the holder, moves in a direction orthogonal to a direction in which the main body is inserted into the holder and the first outer direction, the first support member and the second support member slide on the inclined surfaces and elastically deform in a direction approaching the guide frame.

2. The connector according to claim 1, wherein a position at which the first support member contacts the first contact surface is a position at which the first contact surface and the inclined surface contact each other or a position near the position at which the first contact surface and the inclined surface contact each other.

3. An electronic device comprising:

a housing; and a connector attached to the housing; including a main body and a holder, the main body including:

a connecting member that is one of a plug and a receptacle;

a guide frame that guides in a mounting direction a connected member that is between the other of the plug and the receptacle and that is mounted to the connecting member;

a first support member that protrudes in a first outer direction from the guide frame and that has flexibility in a direction approaching the guide frame; and a second support member that protrudes in a second outer direction, which is opposite of the first outer direction, from the guide frame and that has flexibility in a direction approaching the guide frame; and the holder being a frame body into which the main body is insertable, including:

a first contact surface that is an inner surface of the frame body and to which the first support member contacts when the main body has been inserted into the holder;

a second contact surface that is the inner surface of the frame body and to which the second support member contacts when the main body has been inserted into the holder; and two pairs of inclined surfaces that incline in a direction approaching the main body from both edges of each of the first contact surface and the second contact surface, wherein, when the main body, which been inserted into the holder, moves in a direction orthogonal to a direction in which the main body is inserted into the holder and the first outer direction, the first support member and the second support member slide on the inclined surfaces and elastically deform in a direction approaching the guide frame.

4. The electronic device according to claim 3, wherein a position at which the first support member contacts the first contact surface is a position at which the first contact surface and the inclined surface contact each other or a position near the position at which the first contact surface and the inclined surface contact each other.

* * * * *